US005342513A

United States Patent [19]

Wall et al.

[11] Patent Number: 5,342,513

[45] Date of Patent: * Aug. 30, 1994

[54] MULTIPURPOSE POOL SKIMMER

[75] Inventors: Edward L. Wall, Rte. 1, Box 49, Chickaswa County, Manatee, Miss. 39751; Frank L. Wall, 415 Wilkins-Wise Rd., Columbus, Miss. 39701

[73] Assignees: Edward L. Wall, Manatee; Frank Lee Wall, Columbus, both of Miss.

[ * ] Notice: The portion of the term of this patent subsequent to Aug. 11, 2009 has been disclaimed.

[21] Appl. No.: 988,838

[22] Filed: Dec. 10, 1992

[51] Int. Cl.[5] ..... E04H 4/16

[52] U.S. Cl. ..... 210/169; 210/471; 210/238; 15/1.7; 43/11; 7/106; 7/170

[58] Field of Search ..... 43/11; 7/106, 109, 161, 7/170; 210/169, 238, 470, 471, 474, 495, 776; 15/1.7; 119/5

[56] References Cited

U.S. PATENT DOCUMENTS

| | | | |
|---|---|---|---|
| 944,265 | 12/1909 | Humphreys | 210/471 |
| 1,827,126 | 10/1931 | Washburn | 210/471 |
| 2,610,884 | 9/1952 | Enderle et al. | 294/15 |
| 2,653,403 | 9/1953 | Oslund | 43/11 |
| 3,722,940 | 3/1973 | Misjak | 43/4 |
| 3,747,250 | 7/1973 | Willinger | 43/11 |
| 3,856,679 | 12/1974 | Jackson | 210/471 |
| 4,263,864 | 4/1981 | Carter, Jr. | 43/12 |
| 4,481,117 | 11/1984 | Collins | 210/471 |
| 4,619,065 | 10/1986 | Jones | 43/11 |
| 4,932,150 | 6/1990 | Sher | 43/11 |
| 5,137,623 | 8/1992 | Wall et al. | 210/169 |

*Primary Examiner*—Peter A. Hruskoci
*Assistant Examiner*—Robert James Popovics
*Attorney, Agent, or Firm*—Mason, Fenwick & Lawrence

[57] ABSTRACT

A strainer basket is integrally connected to a rectangular frame that is integrally connected to an elongated handle. At the end of the handle opposite from the frame, the handle broadens into a grip and then narrows and terminates in a small hook; the small hook is designed for removing the covers of skimmer wells in swimming pools. An elongated flange projects from the rectangular frame on the frame side opposite to the handle, and forms an elongated hook that is useful for grasping skimmer basket handles; thus, the tool permits removal and cleaning of skimmer baskets from pool skimmer wells without the user having to bend over and risk contact of their hands with pool scum, dead leaves, and the occasional live snake or other undesirable live or deceased animals encountered during the cleaning of pool skimmers.

Preferably, the tool is formed from a polypropylene homopolymer or other chemically resistant polymer, and is molded in an injection molding process, with the elongated hook of the frame formed by use of a core mounted between upper and lower mold sections.

25 Claims, 7 Drawing Sheets

MULTIPURPOSE POOL SKIMMER

FIELD OF THE INVENTION

This invention is directed to multipurpose skimmer tools in general and is particularly directed to an improvement in the tool disclosed and claimed in U.S. Pat. No. 5,137,623 and a method for making such improved tools, and more particularly to a multipurpose tool having a rigid screen pool skimmer basket, a first hook useful for lifting pool skimmer well lids, and a second hook useful for removal of conventional pool skimmer baskets.

BACKGROUND OF THE INVENTION

Owners of pools and hot tubs frequently encounter floating debris which must be removed. The floating debris is often manually removed with a skimmer net attached to a long handle. In addition, many pools continuously filter the pool water by circulating it through perforated skimmer baskets that are held in wells formed in the pool sides. Floating debris is captured inside the skimmer baskets, while the pool water drains through the perforations in the baskets and back into the pool. As debris collects in the skimmer baskets, the basket perforations can become clogged to the point where water will no longer flow out of the skimmer baskets so that filtration of debris from the pool water ceases.

In order to prevent skimmer basket clogging, it is necessary to periodically remove the skimmer baskets from wells, and dispose of any trapped debris. The first step in cleaning of the skimmer baskets usually involves removal of the pool skimmer well lids that cover the skimmer wells. The lids are provided so that pool users will not accidently step into the skimmer wells. It is undesirable to put a hook or a protruding handle mechanism on the skimmer well lids since pool users may stub their toe or trip by catching their foot on it. Therefore, most skimmer well lids have flattened tops that are co-planar with the deck surrounding the pool.

Conventional pool skimmer well lids contain at least one small opening, in the form of a circle, oval, or rectangle, into which a finger or hook is inserted to remove the skimmer lid. Removal of the skimmer well lid allows the user to gain access to the skimmer basket resting below in the skimmer well. The conventional method of cleaning pool skimmer baskets requires one to bend over or kneel down in order to remove the skimmer well lid and to remove the skimmer basket from the skimmer well. However, this results in the person's hands contacting pool scum, dead leaves, insects, and the occasional live snake and/or other undesirable live or deceased animals that are entrapped in the skimmer baskets.

Thus, there is a need for a tool that, in addition to straining floating debris from pool water, will enable a user to gain access to pool skimmer wells and to remove skimmer baskets without having to kneel down, and which avoids the need for the user's hands to come in contact with material trapped in pool skimmer baskets.

OBJECTS OF THE INVENTION

Therefore, it is a primary object of this invention to provide a multipurpose tool that will enable users to gain access to pool skimmer wells and to remove skimmer baskets without having to kneel down, and which avoids the need for the user's hands to come in contact with the skimmer well lids, skimmer baskets, or waste material in the skimmer baskets.

It is a further object of this invention to provide a multipurpose tool which, in addition to enabling the user to gain access to pool skimmers and remove skimmer baskets without having to kneel down, has a net which allows the user to remove floating leaves, insects, and other materials from pools and hot tubs.

Yet another object of the present invention is to provide a multipurpose tool which is easy and inexpensive to fabricate and which can be conveniently stored.

An additional object of the present invention is to provide a method for producing and using the multipurpose pool skimmer of the present invention.

SUMMARY OF THE INVENTION

These and other objects are achieved by the multipurpose pool skimmer tool of the present invention. The multipurpose tool includes a net attached to a rectangular net frame that is integrally connected to one end of an elongated handle. A grip is formed at the opposite end of the handle from the net frame, and the handle grip terminates in a small hook which is useful for lifting pool skimmer well lids. In a preferred embodiment, the small hook is reinforced with exterior horizontal flanges, and a hole is provided through the handle grip, proximate to the skimmer well lid hook, that facilitates hanging of the multipurpose tool on a hook. The grip is preferably designed so that the manufacturer, wholesaler or retailer can print engrave, emboss, or label a trademark or name on the device, such as "Lil' Dipit," or provide the name and address of a company where the user can obtain this highly useful and greatly needed tool. Ample space is provided on the grip so that the entire name, address, and phone number of a particular manufacturer or retailer can be inserted on one side of the grip.

A second hook projects from the net frame on the side of the frame opposite from the net handle. The second hook is formed from a long flange which projects upward from the net frame. The upwardly projecting flange preferably bends toward the net and terminates in a lip. The second hook is designed to accommodate the shape of conventional pool skimmer basket handles.

Preferably, the multipurpose pool skimmer is formed by injection of polypropylene homopolymer into a three-piece mold. During a first preferred injection molding process, the net is held in place by a series of pins projecting from opposed sides of the mold. During a second preferred injection molding process, the net frame is molded as two separate pieces which hold the net in place when subsequently assembled and rigidly fixed together. In a third preferred embodiment, the multipurpose pool skimmer is formed in a three-piece mold according to either the first or the second preferred embodiment and the tool includes a strainer basket. The multipurpose tool can also be made by a variety of other processes, and can be made of a variety of other materials, such as wood, metal, or plastic.

DETAILED DESCRIPTION OF THE INVENTION

To facilitate description of the preferred and other embodiments of the present invention discussed below, reference is made in FIGS. 1, 2, and 3 to an imaginary longitudinal axis 1. Reference is also made to a first horizontal plane (not shown) and a first vertical plane (not shown), each of which passes through axis 1. Unless modified in the description of this invention, the term "beam" as used hereinafter refers to a member that has a linear length greater than its width and height and that has a substantially rectangular cross-section. In addition, "opposite ends" refers to the ends of any member with the ends defined by imaginary spaced, parallel, cross-sectional planes that are orthogonal to the centerline of the member's longest dimension.

THE FIRST EMBODIMENT

Figure 1:
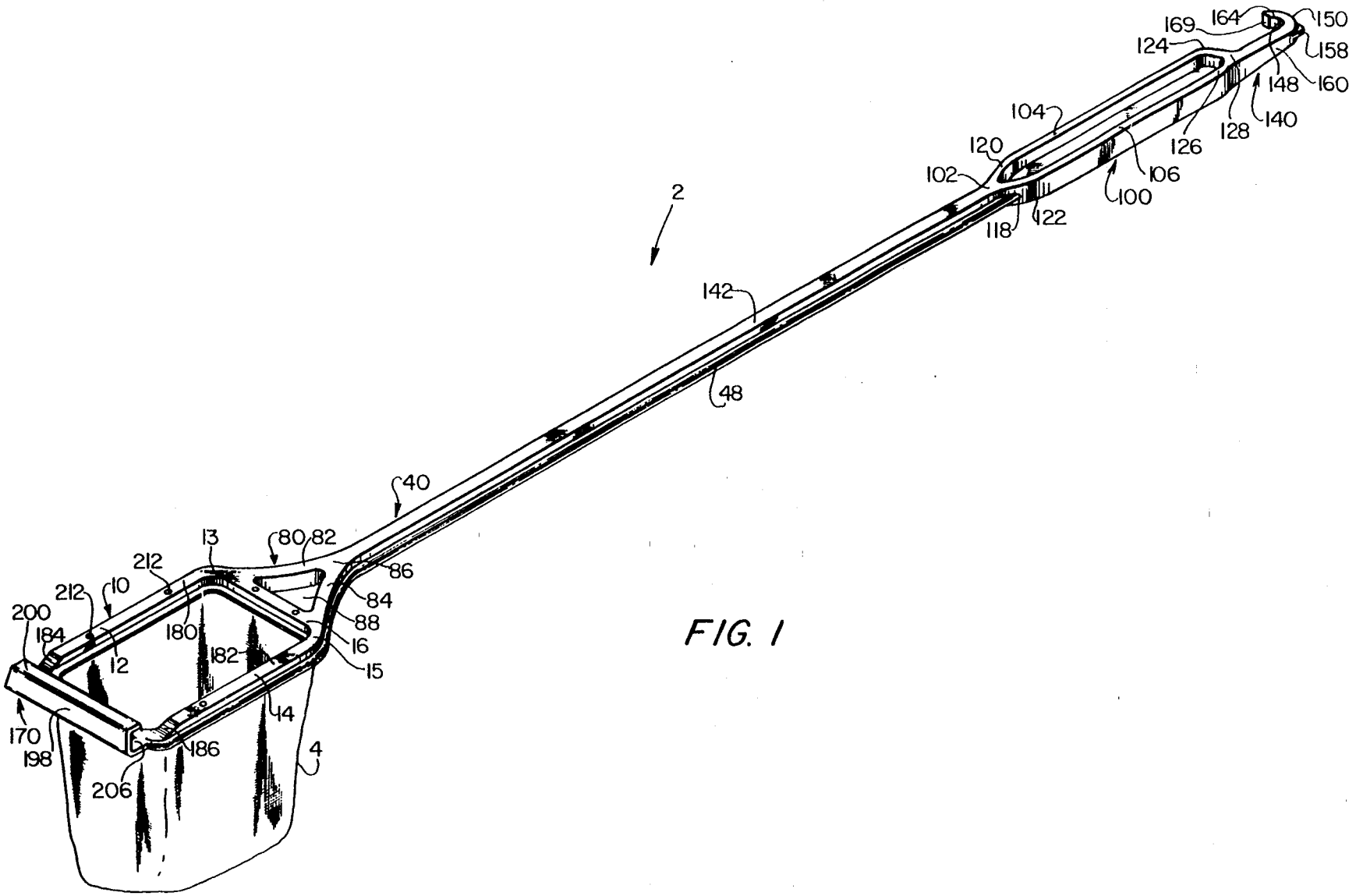
FIG. 1 is a perspective view of a first embodiment of the subject invention.
Figure 2:
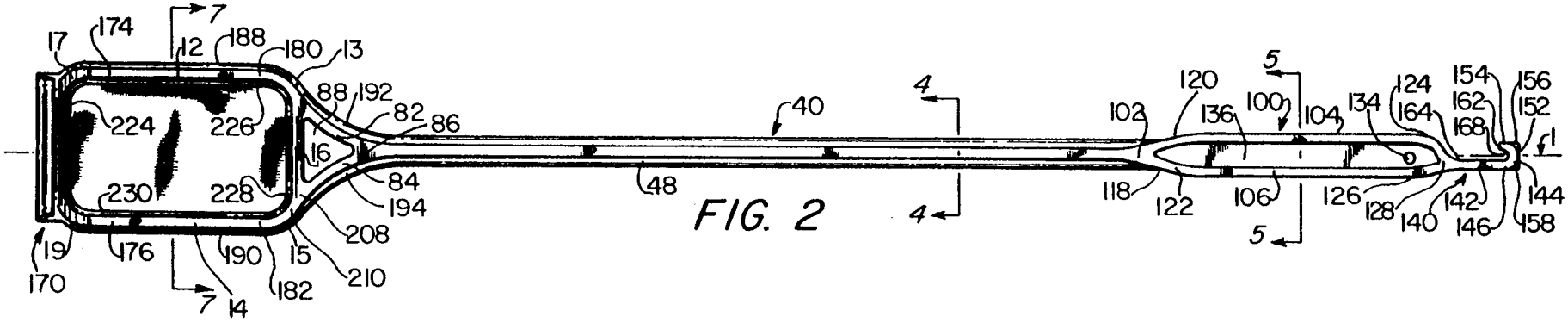
FIG. 2 is a top plan view of the first embodiment of the invention.
Figure 3:
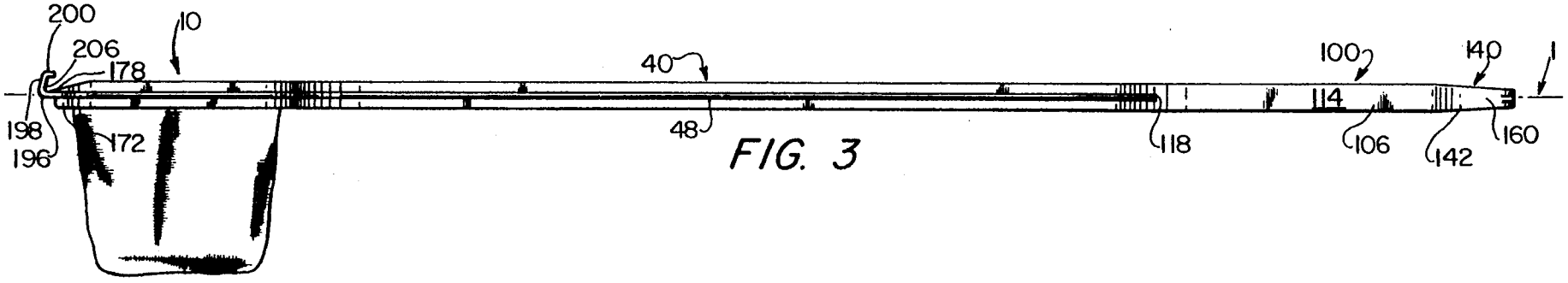
FIG. 3 is a front elevation view of the preferred embodiment of the invention.

With reference to FIGS. 1, 2, and 3, the first embodiment of the multipurpose tool of the present invention is illustrated. Preferably, tool 2 is formed with a net 4 suspended from a rectangular frame 10 that is integrally connected to a handle 40 via a neck 80. Handle 40 merges into and terminates in an elongated grip 100. The horizontal center of handle 40 lies in a vertical plane co-existing with imaginary longitudinal axis 1. Grip 100 extends from handle 40 and terminates in a skimmer well lid hook or first hook 140, which is located at the posterior end of tool 2. An elongated hook or second hook 170, which is located at the anterior end of tool 2, extends from frame 10 at the opposite end of tool 2 from first hook 140.

Frame 10 is preferably rectangular in shape and is formed from two sides 12 and 14, a handle piece or cross member 16, and second hook 170. Sides 12 and 14 are elongated, linear, and aligned in spaced, parallel relationship with their vertical centers lying in the first horizontal plane. Sides 12 and 14 have essentially identical mirrored cross-sections about the first vertical plane, are equidistantly spaced from axis 1, and are perpendicular to cross member 16 and second hook 170. Cross member 16 has its opposite ends integrally connected to the posterior ends of sides 12 and 14 at corners 13 and 15, respectively. Second hook 170 is connected to the anterior ends of sides 12 and 14 at corners 17 and 19, respectively (see FIG. 2). Corners 13, 15, 17, and 19 are radial so that cross member 16 and second hook 170 merge into sides 12 and 14 in a smooth and continuous fashion.

Neck 80 is formed by two sides 82 and 84 that connect handle 40 to cross member 16 on frame 10. The posterior ends of sides 82 and 84 meet to form a Y-shaped junction 86 at the anterior end of handle 40. The anterior ends of sides 82 and 84 are connected to cross member 16 at corners 13 and 15, respectively. Sides 82 and 84 preferably curve outward from junction 86 so that sides 82 and 84 smoothly merge into radial corners 13 and 15, respectively. Preferably, the vertical centers of sides 82 and 84 and cross member 16 are aligned in the first horizontal plane.

In a preferred embodiment, a gap 88 is formed between sides 82 and 84 and cross member 16. Gap 88 enables the use of less material without substantially decreasing the strength of tool 2. It has been discovered that, when tool 2 is formed by injection molding, molds that leave a gap, such as gap 88, result in a more uniform molding of frame 10. Gap 88 is also useful as an additional place to grip or hang tool 2. It is envisioned that frame 10 may be formed in a variety of other shapes, such as a circle, oval, or a complex geometric structure.

Figure 4:
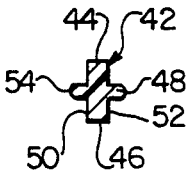
FIG. 4 is a cross-section of the handle taken along line 4—4 of FIG. 2.

With reference to FIG. 4, a cross-section of handle 40, taken along line 4—4 of FIG. 2, illustrates that handle 40 is formed from a beam 42, which preferably has a rounded top edge 44 and a rounded bottom edge 46. Ribs or braces 48 extend horizontally an equal distance outward from the vertical centers of opposed vertical surfaces 50 and 52 of beam 42 and have rounded outer edges 54. Note that handle 40 may have a variety of other cross-sectional shapes, e.g., circular, or rectangular, and may be solid or tubular.

Referring back to FIGS. 1, 2 and 3, note that the anterior end of grip 100 is integrally attached to the posterior end of handle 40 at junction 102. Beam 42 of handle 40 divides into two beams 104 and 106 at junction 102 to form a Y-shape.

Figure 5:
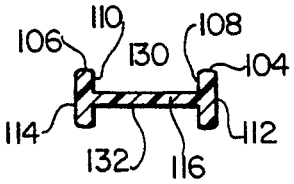
FIG. 5 is a cross-section of the grip taken along lines 5—5 of FIG. 2.

With reference to FIG. 5, a cross-section of grip 100 taken along line 5—5 of FIG. 2 is illustrated. Beams 104 and 106 have a similar cross-sectional shape to beam 42 of handle 40. Beam 104 has an inner vertical surface 108 that faces the inner vertical surface 110 of beam 106, and beams 104 and 106 have vertical outer surfaces 112 and 114, respectively, that face outwardly from grip 100. A platform 116 extends between the vertical centers of inner surfaces 108 and 110 of beams 104 and 106, respectively.

Referring again to FIGS. 1, 2, and 3, beams 104 and 106 extend outwardly from axis 1 to intersect ribs 48 of handle 40 at interface 118. Ribs 48 terminate at outer surfaces 112 and 114 of beams 104 and 106, with outer edges 54 of ribs 48 meeting the outer surfaces 112 and 114 of beams 104 and 106.

Beams 104 and 106 diverge until they gently curve at corners 120 and 122 and become parallel to axis 1. Preferably, the parallel portion of beams 104 and 106 has a length greater than the width of a human hand, thereby forming sides for grip 100. Beams 104 and 106 gently curve and converge towards axis 1 and each other at corners 124 and 126. Note, that the radius of corner 124 is smaller than the radius of corner 126. Beams 104 and 106 merge together to form junction 128 at the posterior end of grip 100. Due to the differences in the location and curvature of corners 124 and 126, the vertical center of junction 128 is horizontally offset from axis 1.

Note that the parallel portion of beams 104 and 106 are preferably equidistant from axis 1 and that the vertical centers of beams 104 and 106 lie in the same horizontal plane with axis 1. Platform 116 preferably is co-planar with the horizontal plane passing through axis 1, is of the same thickness as ribs 48, and is integrally connected to beams 104 and 106.

Referring again to FIG. 5, note that it is preferred that platform 116 have a vertical height or thickness that is less than the vertical height of beams 104 and 106. Thus, platform 116 is preferably recessed into grip 100, and has a top surface 130 and a bottom surface 132. Referring again to FIGS. 1, 2, and 3, it is preferred that the width of grip 100 be greater than the width of handle 40 to make it easier for a user to grasp and manipulate tool 2 by grip 100. Further, depending on the material used to form beams 104 and 106, platform 116 may be made vertically thicker or eliminated entirely. It is envisioned that, in other embodiments, grip 100 may be formed from solid or tubular materials of various geometric configurations, or the grip may be dispensed with entirely so that first hook 140 extends directly from handle 40.

A hole 134 is preferably provided in platform 116 near junction 128 of grip 100, and top surface 130 of platform 116 is substantially planar so that a trade name or other information can be applied. For example, with reference to FIG. 2, the preferred name and trademark for tool 2, "Lil Dipit" 136, is artfully illustrated on the upper surface 130 of platform 116.

It is preferred that the bottom surface 132 of platform 116 also be planar so it can be embossed, engraved, printed or labeled with the name of the best source for obtaining this device, and other necessary pool and hot tub supplies, e.g., MODERN POOL SYSTEMS, 415 Wilkens-Wise Road, Columbia, Miss. 39703 (601) 327-6724. Of course, it is envisioned that other information may be molded, printed, embossed, or applied via labels to platform 116, such as the names of companies or organizations which may wish to give away or sell the multipurpose tool of the present invention for promotional purposes.

Referring back to FIGS. 1, 2, and 3, note that the posterior end of junction 128 of grip 100 is integrally attached to the anterior end of beam 142. Beam 142 has the same cross-sectional shape as beams 42, 104, and 106 at junction 128. Preferably, beams 104, 106, and 142 are not reinforced with horizontal ribs as beam 142 in handle 40 is. Beam 142 is parallel to and offset from axis 1, and has a vertical center that lies in the same plane with axis 1. Beam 142 is tapered so that its height diminishes an equal amount above and below axis 1 as it extends away from junction 128.

First hook 140 is formed from a curved beam 144 that has a first end 146 integrally formed into the posterior of linearly extending beam 142. Curved beam 144 has an inner vertical surface 148 and an outer vertical surface 150; beam 144 is preferably radially curved to form a smooth arc; the horzontal and vertical center of the posterior end 152 of curved beam 144 is aligned with axis 1. Beam 144 terminates in a short linearly extending beam 154 that is substantially parallel to and co-planar with beam 142. Beams 144 and 154 preferably have the same vertical height and horizontal width as beam 142 where it meets first end 146 and beam 144.

Triangular flanges 156 and 158 extend horizontally outward from the vertical center of outer surface 160 of beam 144 and lie in the same horizontal plane as axis 1. Flanges 156 and 158 provide support for first hook 140 so that heavier objects may be lifted without bending or breaking first hook 140. Flanges 156 and 158 preferably do not extend beyond the posterior end 152 of curved beam 144, and do not horizontally extend outward from axis 1 beyond the outer surfaces 160 and 162 of beams 142 and 154, respectively.

In a preferred embodiment, the combined widths of beams 142 and 154, together with the diameter of curved beam 144, are less than the distance between the outer surfaces 112 and 114 of beams 104 and 106, respectively, in grip 100. Note that inner surfaces 164, 166, and 148 define a gap 168 that has a size sufficient to allow first hook 140 to be inserted far enough into the openings in conventional pool skimmer well lids so that the tip 169 of first hook 140 will extend beyond the bottom surface of the lid when first hook 140 is inserted through a hole in the top of the lid.

Depending upon the strength of the materials used to form tool 2 and the weight of the lids to be removed with first hook 140, the vertical height of flanges 156 and 158 may vary, and, in some embodiments, flanges 156 and 158 may be eliminated. Further, it is envisioned that hook 40 and grip 100 will take on a variety of different shapes and sizes.

With further reference to FIGS. 1, 2, and 3, note that second hook 170 of frame 10 is preferably formed from a beam 172 which merges at radial corners 17 and 19 with beams 174 and 176 of sides 12 and 14, respectively. The upper surface 178 of beam 172 slopes downward towards the anterior of tool 2 from the upper surfaces 180 and 182 of beams 174 and 176, respectively. The front ends 184 and 186 of upper surfaces 180 and 182, respectively, are preferably also sloped downward towards the anterior of tool 2 to lie in the same oblique plane with upper surface 178 of beam 172.

Ribs 188 and 190 project horizontally outward an equal distance from the vertical centers of beams 174 and 176, respectively, and follow the contours of corners 17 and 19, respectively, until they terminate into projection 90 at the front of tool 2. Ribs 188 and 190 follow the contours of corners 13 and 15, respectively, at the posterior of frame 10 and preferably merge with ribs 192 and 194, respectively, that extend from the vertical centers of the outer surfaces of beams 82 and 84, respectively, in neck 80. Preferably, ribs 192 and 14 merge into ribs 48 that project from beam 42 in handle 40. Thus, in a preferred embodiment, a continuous rib extends horizontally outward from the sides of handle 40, neck 80, and sides 12 and 14 of frame 10.

Figure 6:
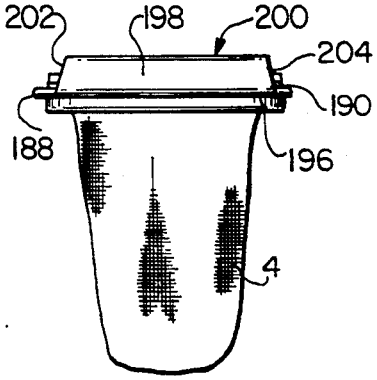
FIG. 6 is a left side elevation view of the first embodiment of the present invention.

Projection 196 extends horizontally outward from the front of beam 172 and is preferably rectangular in shape. Extending upward from the front of projection 196 is a flange 198 that terminates in a lip 200. With additional reference to FIG. 6, note that lip 200 has a width that is less than the width of projection 196. Thus, sides 202 and 204 of flange 198 are sloped inward rather than being vertical; preferably, sides 202 and 204 are sloped inward at an angle of approximately 15° from vertical for a purpose to be described later.

With particular reference to FIGS. 1 and 3, a space 206 is formed between flange 198, lip 200, top surface 178 of beam 172, and top surfaces 184 and 186 of beams 174 and 176, respectively. Space 206 is preferably large enough to accommodate conventional skimmer basket handles. Preferably, flange 198 has sufficient vertical height that lip 200 projects above upper surfaces 180 and 182 of beams 174 and 176, respectively.

Cross member 16 is preferably formed from a beam 208 which is substantially similar in cross-section to beams 174 and 176 of sides 12 and 14, respectively. Beam 208 is in spaced, parallel relationship with beam 172 of second hook 170, and beam 208 has a top surface 210 that is co-planar and continuous with top surfaces 180 and 182.

Figure 7:
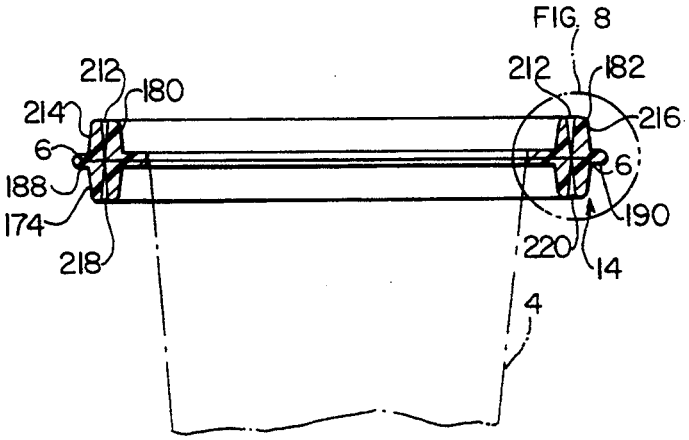
FIG. 7 is a cross-section of the net frame and net taken along line 7—7 of FIG. 2.

In a preferred embodiment, conical orifices 212 project downward into top surfaces 180, 182, 210, and 178. With reference to FIG. 7, a cross-section of frame 10 and net 4, taken along lines 7—7 of FIG. 2, is illustrated. Sides 12 and 14 are shown having beams 174 and 176, respectively, with ribs 188 and 190, respectively, extending horizontally outward an equal distance from the vertical centers of outer surfaces 214 and 216. Cross-sections of four conical orifices 212 are illustrated, with two projecting downward into upper surfaces 180 and 182 and two projecting upward into lower surfaces 218 and 220. Note that the diameter of orifices 212 are greater at surfaces 180, 182, 218, and 220 than at the vertical centers of beams 174 and 176, and that the orifices terminate at approximately the vertical center of beams 174 and 176. Orifices 212 result from a preferred molding process which will be described in greater detail at a later time. Note that the upper edge 6 of net 4 is encapsulation molded into sides 12 and 14, cross member 16, and second hook 170.

Figure 8:
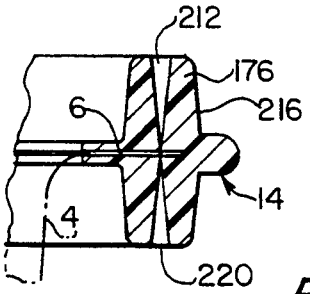
FIG. 8 is an expanded cross-section of the circled portion of the net frame of FIG. 7.

With reference to FIG. 8, an expanded cross-sectional view of side 14, taken from the encircled portion of FIG. 7, is illustrated. Note that upper edge 6 of net 4 extends horizontally through the vertical center of side 14 and that the bottom of the conical orifice 212 projecting downward into beam 176 meets the top of the conical orifice 222 projecting upward from the bottom of beam 176.

Conical orifices 212 and 222 are formed in a preferred injection molding process by pins that are located in upper and lower mold sections used to mold tool 2. The pins are designed to hold upper edge 6 of net 4 in place during injection molding of tool 2. Before molding tool 2, the upper edge 6 of net 4 is placed on the pins attached to the bottom portion of a mold. The bottom portion and the upper portion of the mold have interior shapes that are identical to the exterior shapes of the upper and lower portions of tool 2, excluding net 4.

For ease in describing the invention, the upper portion of tool 2 is defined as the portion extending above the horizontal plane passing through axis 1, and the lower portion is defined as the portion extending below the horizontal plane. The upper portion of the mold has pins which are aligned so that the tips of the pins in the upper part of the mold can meet the tips of the pins in the lower portion of the mold; the tips of the pins meet when the mold portions are assembled to tightly grip the net in the correct position for the injection molding process.

In a preferred embodiment, tool 2, excluding net 4, is formed from a polypropylene homopolymer. Those of skill in the art will recognize that there are many grades of polypropylene, and that a variety of compounds can be combined with polypropylene to alter its strength, flexibility, color, melting point, chemical resistance, and injection molding characteristics. A polypropylene homopolymer is preferred that, when cooled to a rigid or semi-rigid solid material, has a specific gravity lower than the specific gravity of water; this will enable the resulting tool to float in water.

In a preferred embodiment, polypropylene is heated to 400° F. prior to injection molding, and the mold is water cooled until the polypropylene hardens. Since the outer surface of the tool will cool and harden first, the molded tool can be ejected from the molds prior to complete solidification. For example, the surface of the molded portions of the tool may be at 90° F., while the interior of the molded portions may be at a much higher temperature; thus, the exterior of the tool may heat up to temperatures in excess of 150° F. after removal from the molds, before the tool finally cools off to ambient temperature and become completely solidified. While polypropylene is a preferred material for forming tool 2, note that other polymers or materials may be used; further, such additives as glass fiber reinforcing, talc, or mica may be combined with the polymer to alter the strength of the resulting tool.

With reference to neck 80, it has been discovered that the best location in the mold for injecting polymeric material during preferred injection molding processes is at the portion of the mold that forms handle 40 near junction 86 of neck 80. It has also been discovered that by diverting the flow of injected polymer material so that neck 80 forms gap 88, a more uniform molding process results which places less stress on the top edge 6 of net 4 during molding. If the flow of injected polymer material is not diverted into two streams away from handle piece cross member 16, the top edge 6 of net 4 may be displaced in the cross member 16 during injection.

Since net 4 extends out of the mold, ribs 224, 226, 228, and 230 on the interior of frame 10 have a different shape than ribs 188 and 190 on the exterior of frame 10. Preferably, ribs 224, 226, 228, and 230 extend an equal distance horizontally in the first plane, and are connected to form a continuous rib about the interior of frame 10. Ribs 224, 226, 228, and 230 preferably terminate where the mold terminates. Note that plastic may ooze out during the molding process between the spaces of the upper and lower mold pieces caused by the netting; this may result in an inner lip of plastic (not shown) projecting from ribs 224, 226, 228, and 230.

In a preferred embodiment, 8 pins are utilized in the upper side and 8 pins are utilized in the lower side of the mold to hold top edge 6 of net 4 in place during injection molding (a total of 16 pins). Thus, 8 conical orifices 212 will be visible in upper surfaces 180, 182, 210 and 178 and 8 conical orifices (not shown) will be visible in the bottom surfaces. Please note that the conical orifices could be subsequently filled with plastic or other material, and that other molding processes may not leave visible holes. Other embodiments of the multi-purpose tool of the present invention can also be made from wood, metal, or other plastics with substantially altered net, frame, handle, first hook, second hook, and grip construction details.

In a preferred embodiment, the net is formed of a 0.05 inches by 0.05 inches mesh of nylon with a height of 5 inches, a width of 3 inches, and a length of approximately 4 inches. Although a nylon or other polyamide net has been utilized in a preferred embodiment, any other suitable net material may be used; further, another straining device may also be used in place of or with a net.

Preferably the width of frame 10 is 4 inches, and tool 2 has a total length of 36 inches as measured from bottom 152 of hook 140 to flange 198. Handle 40 preferably has a width of 0.625 inches and a height of 0.625 inches, while beams 42, 104, 106, 174, 116, 176, and 172 have a height of 0.625 inches and horizontal widths of 0.250 inches.

Ribs 48, 188, 190, 192 and 194 preferably have a height of 0.125 inches and widths of 0.1875 inches. Hole 60 in grip 100 preferably has a diameter of 0.25 inches. Grip 100 preferably has a width of 1 inch and the width of hook 40 is 0.625 inches. However, the dimensions given above for a preferred embodiment can be greatly altered to meet different design or strength requirements as would be obvious to one of skill in the art.

Note that, in a preferred embodiment, first hook 140 is bent so it lies in the same plane as frame 10, handle 40, grip 100, and axis 1. This enables the "Lil Dipit" to be hung on a nail or a hook which can be inserted through hole 134 in grip 100. While it is envisioned that first hook 140 may also project perpendicularly to the horizontal plane passing through axis 1, this arrangement will make it more difficult to hang the tool, preferably referred to as the "Lil Dipit", on a nail inserted through hole 134, and may result in inadvertently catching first hook 140 on clothing or other material. This is less likely to occur when first hook 140 is bent so it lies in the same plane with grip 100; since grip 100 is wider than first hook 140, it will act to divert garments, etc. which may slide along outer surface 112 of beam 104 towards hook 140. However, tool 2 may also be hung by inserting a nail, hook, or other protuberance into gap 88 in neck 80 or into the opening for net 4 in frame 10.

A preferred mold for a preferred embodiment of tool 2 is made up of three pieces. The first mold piece forms the portion of tool 2 that lies below the first horizontal plane. The second and third mold pieces together form the portion of tool 2 that lies above the first horizontal plane. The third mold piece is separable from, and attachable to, the second mold piece; the third mold piece is designed to fit between the connected first and second mold pieces, and has an exterior shape that corresponds to the shape of space 206 formed by the interior surfaces of second hook 170. The sloped sides 202 and 204 of flange 198 allow for easier separation of the third mold piece from the second mold piece, and facilitates removal of the tool 2 from the mold itself.

Preferably, a polymeric material will be introduced into one side of the mold cavity via a standard injection gate, which is defined by the first and second mold pieces with its vertical center located in the first horizontal plane, just aft of neck 80. The first and second mold pieces have standard exhaust vents situated in a manner that is conventionally used by those of skill in the art.

A preferred molding process comprises the following steps:

1. The top edge of a net is impaled on or rested upon holding pins contained in the portion of the first mold piece that forms the lower portion of rectangular frame 10.
2. The third mold piece is secured to the second mold piece such that it forms the molding cavity for second hook 170.
3. The assembly made up of the second and third molding pieces is joined with the first mold piece to form the complete molding cavity. (It should be noted that in a preferred embodiment the holding pins in the first molding piece meet with the holding pins of the second molding piece thereby "trapping" the net between them and holding it in place throughout the molding process.)
4. A heated polymeric material is then introduced into the mold by injection, with air escaping from appropriately placed vents in the molding cavity.
5. After the exterior surface of the injected material cools to a solid form, the assembly made up of the second and third molding piece is separated from the first mold piece with the molded tool held in the second mold piece by the third mold piece.
6. The third mold piece is separated from the second mold piece sufficiently to allow enough clearance so that the molded tool can be removed; it may also be possible to rotate the molded tool without detaching the third mold piece from the second mold piece so as to detach hook 170 from the mold (provided the polymeric material used is sufficiently flexible).
7. The gate runner is trimmed away from the cooled tool.
8. The tool is then finished in the conventional manner.

This description is but one variation of many possible molding processes, and it is envisioned that injection gates may be placed at various locations and orientations and that the mold may be formed with a plurality of cavities to facilitate forming more than one tool during each injection cycle.

THE SECOND EMBODIMENT

Figure 9:
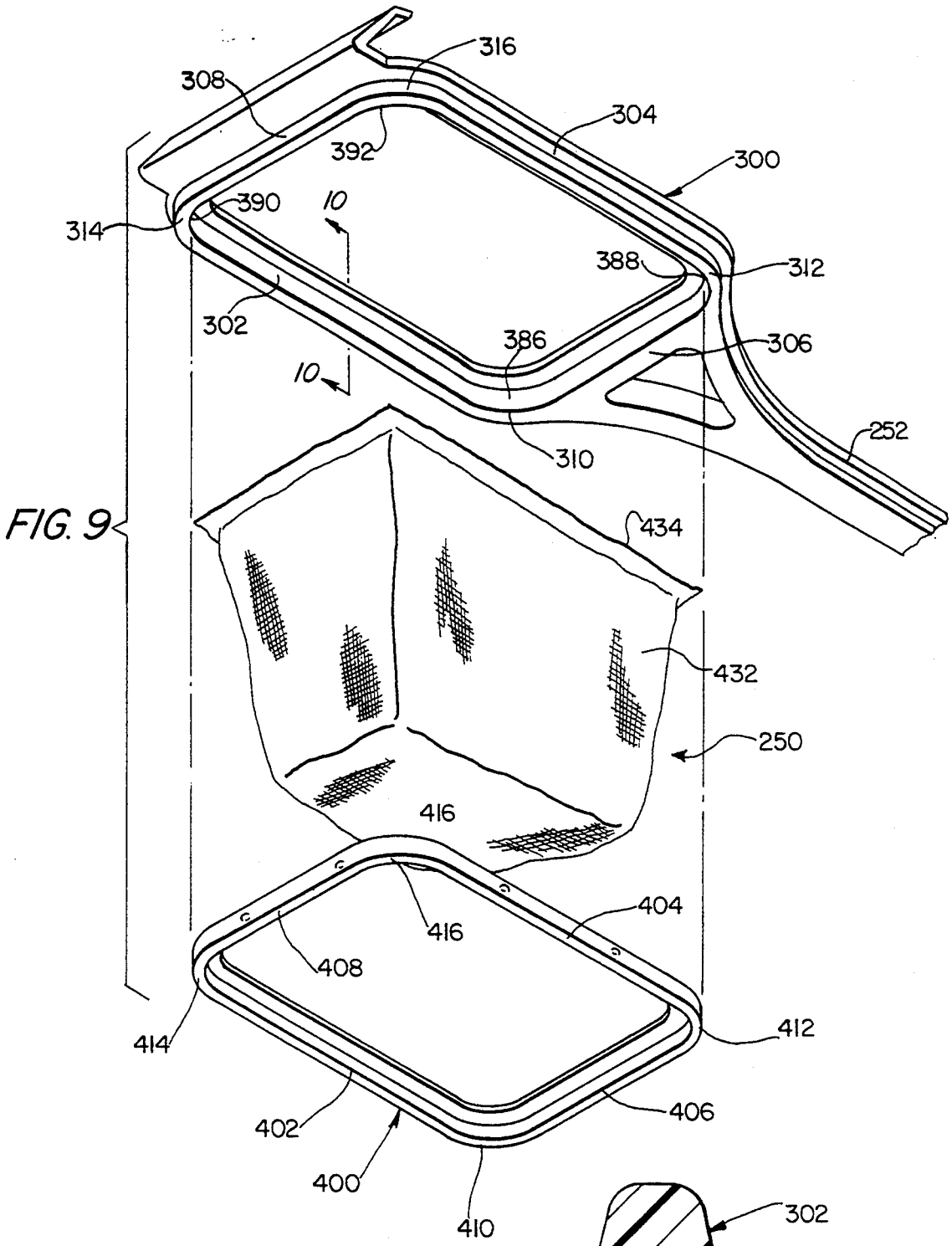
FIG. 9 is an exploded view of the frame and net portions of a second embodiment of the invention.
Figure 10:
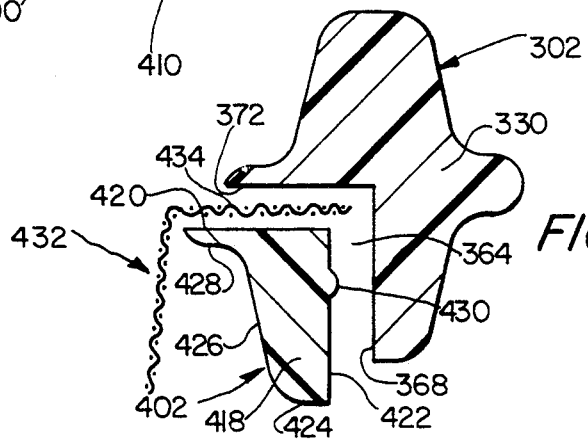
FIG. 10 is an exploded cross-section of a portion of the net frame of the second embodiment of the invention taken along line 10—10 of FIG. 9.
Figure 11:
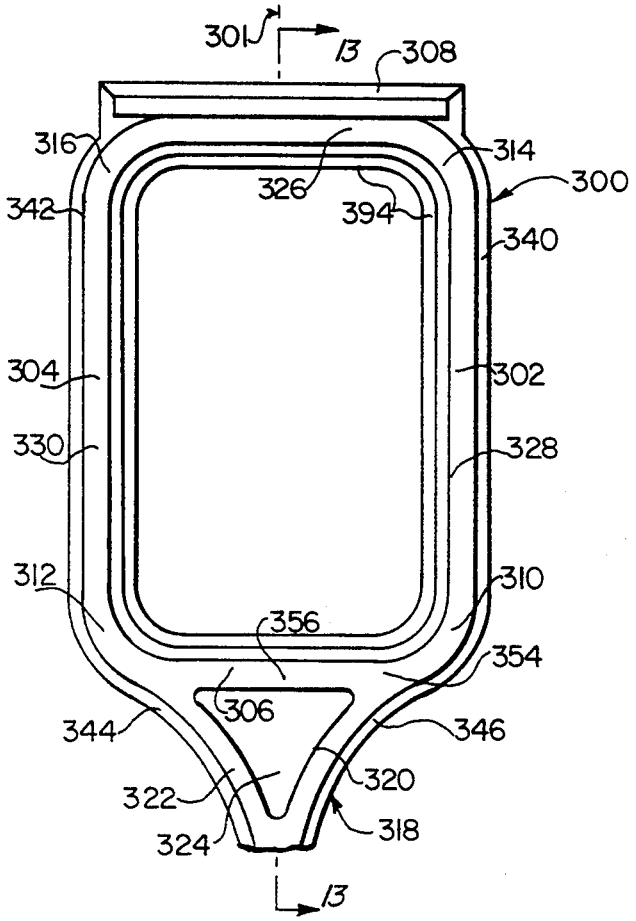
FIG. 11 is a partial top plan view of the second embodiment of the present invention.

With reference to FIGS. 9, 10, and 11, a frame portion 250 of a second preferred embodiment of the present invention is illustrated. Frame 250 is formed of two parts: a main section 300 and an insert section 400. Frame 250 is attached to an elongated handle 252 which preferably terminates in a small narrow hook (not shown). The small hook should preferably be suitable for the removal of skimmer well lids. It is also preferred that a grip (not shown) be formed in the elongated handle to facilitate hand manipulation.

With additional reference to FIG. 11, main section 300 is preferably rectangular in shape, and is formed from sides 302 and 304, cross member 306, and a second hook 308. Side parts 302 and 304 are elongated, linear, and aligned in spaced, parallel relationship with their vertical centers lying in a first horizontal plane. Sides 302 and 304 have essentially identical mirrored cross-sections about a first vertical plane, are equidistantly spaced from axis 301, and are perpendicular to both cross member 306 and second hook 308. Cross member 306 has its opposite ends integrally connected to the posterior ends of sides 302 and 304 at corners 310 and 312, respectively. Second hook 308 is connected to the anterior ends of sides 302 and 304 at corners 314 and 316, respectively. Corners 310, 312, 314, and 316 are radial so that cross member 306 and second hook 308 merge into sides 302 and 304 in a smooth and continuous fashion.

Preferably, neck 318 is formed from sides 320 and 322 which smoothly merge into radial corners 310 and 312, respectively. The vertical centers of sides 320 and 322 and cross member 306 are preferably aligned in the first horizontal plane. In addition, a gap 324 is formed between sides 320 and 322 and cross member 306. Gap 324 facilitates the use of less material without substantially decreasing the strength of the tool. It has been discovered that molds that leave a gap, such as gap 324, result in a more uniform molding of main frame section 300. Gap 324 is also useful as an additional place to grip or hang the tool. It is envisioned that main frame section 300 may be formed in a variety of other shapes, such as a circle, oval, or a complex geometric structure.

Figure 12:
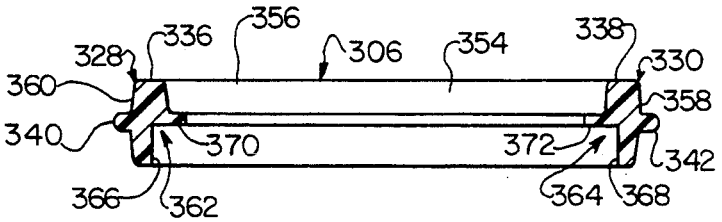
FIG. 12 is a cross-section of the main frame section of the second embodiment taken along line 12—12 of FIG. 11.
Figure 13:
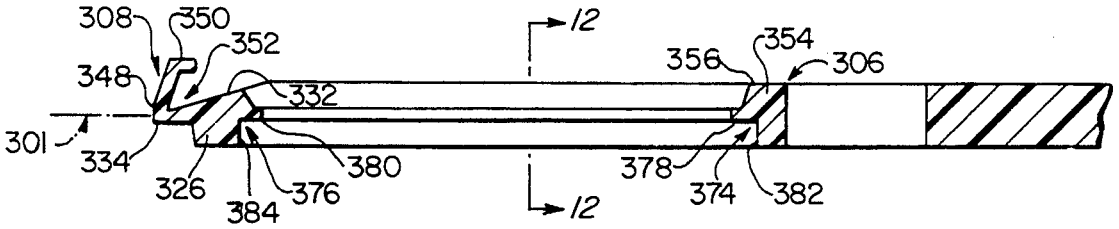
FIG. 13 is a cross-section of the main frame section of the second embodiment taken along line 13—13 of FIG. 11.

Referring to FIGS. 11, 12, and 13, note that second hook 308 is formed from a beam 326 which merges at radial corners 314 and 316 with beams 328 and 330, respectively. The upper surface 332 of beam 326 slopes downward towards projection 334 from the upper surfaces 336 and 338 of beams 328 and 330, respectively.

Ribs 340 and 342 project horizontally outward an equal distance from the vertical centers of beams 328 and 330, respectively, and follow the contours of corners 314 and 316, respectively, until they terminate into projection 334 at the front of frame section 300. Ribs 340 and 342 preferably follow the contours of corners 310 and 312, respectively, at the posterior of main frame section 300, and merge with ribs 344 and 346, respectively, that extend from the vertical centers of the outer surfaces of beams 320 and 322, respectively, in neck 318. Projection 334 preferably extends horizontally outward from the front of beam 326 and is rectangular in shape. Extending upward from the front of projection 334 is a flange 348 that terminates in a lip 350, thereby forming space 352.

Cross member 306 is preferably formed from a beam 354 which is substantially similar in cross-section to beams 328 and 330 of main side parts 302 and 304, respectively. Beam 354 is in spaced, parallel relationship with beam 326 of second hook 308, and beam 354 has a top surface 356 that is co-planar and continuous with top surfaces 336 and 338.

With reference to FIGS. 12 and 13, cross-sections of frame section 300, taken along lines 12—12 and 13—13 of FIG. 11, respectively, are illustrated. Side parts 302 and 304 are formed from beams 328 and 330, respectively, with ribs 340 and 342 extending horizontally outward an equal distance from the vertical centers of outer surfaces 358 and 360, respectively.

With particular reference to FIG. 12, note that beams 328 and 330 have notches 362 and 364. Notches 362 and 364 are formed by inner vertical surfaces 366 and 368 that intersect at right angles lower horizontal surfaces 370 and 372. Preferably, vertical surfaces 366 and 368 are co-planar with the vertical planes passing through the center lines of beams 328 and 330, and lower horizontal surfaces 370 and 372 are co-planar with the horizontal plane that passes through the center line of beams 328 and 330.

With particular reference to FIGS. 9 and 13, note that beam 326 of second hook 308 and beam 354 of cross members 306 contain notches 374 and 376. Notches 374 and 376 are formed from lower horizontal surfaces 378 and 380 which meet lower vertical surfaces 382 and 384 at right angles. Preferably, lower horizontal surfaces 378 and 380 are co-planar with the horizontal plane that passes through axis 301. Preferably, surface 382 is co-planar with the vertical plane passing through the center line of beam 354, and vertical surface 384 is planar and parallel to vertical surface 382.

Preferably, vertical surfaces 382 and 384 are perpendicular to vertical surfaces 366 and 368, and horizontal surfaces 378 and 380 are perpendicular to 366 and 368. In a preferred embodiment, vertical surfaces 366 and 368 merge into vertical surfaces 382 and 384, and horizontal surfaces 370 and 372 merge into horizontal surfaces 378 and 380 to form a rectangularly shaped notch in the bottom of frame piece 300. In a preferred embodiment, the intersection of notches 374 and 376 with notches 362 and 364 form rounded corners 386, 388, 390 and 392. With further reference to FIGS. 11, 12, and 13, note that inwardly projecting horizontal ribs 394 have only approximately one-half the vertical height of outwardly extending ribs 340 and 342. It is envisioned that ribs 394 may be substantially altered in shape or eliminated in certain embodiments.

Referring again to FIGS. 9 and 10, insert frame section 400 is preferably rectangular in shape and is formed from sides 402, 404, 406, and 408. Sides 402, 404, 406, and 408 are elongated and linear, and have substantially rectangular cross-sections. Sides 402 and 404 are in spaced, parallel relationship and are perpendicular to sides 406 and 408. Side 406 has its opposite ends integrally connected to one end of sides 402 and 404 to form corners 410 and 412, respectively. The ends of side 408 are connected to the other ends of sides 402 and 404 to form corners 414 and 416, respectively. Corners 410, 412, 414, and 416 are radial so that cross member 406 and side 408 merge into sides 402 and 404 in a smooth and continuous fashion.

FIG. 10 illustrates a cross-section of side 302 of frame piece 300 and side 402 of frame piece 400. Side 402 has a beam 418 with a planar horizontal upper surface 420 which meets a substantially planar vertical surface 422 at a right angle. Lower surface 424 meets vertical surface 422 at a right angle; lower surface 424 preferably smoothly curves upward into outer surface 426 which may either be vertical or sloped slightly outward from the center of beam 418. Surface 426 preferably smoothly merges into inner rib 428 which shares upper surface 420 with beam 418.

An energy director 430 is provided on vertical surface 422. Energy directors, such as 430, may be provided on upper surface 420, as well as on horizontal surface 372 and vertical surface 368 of beam 330 in side 302. Note that notch 364 has inner dimensions which preferably mirror upper side 420 and vertical side 422 of side 402, and that sides 404, 406, and 408 preferably have identical cross sectional shapes to side 402. The energy directors are useful in ultrasonically welding insert frame 400 into the cavity formed by notches 362, 364, 374, and 376 in frame piece 300.

In a preferred embodiment, net 432, frame section 300, and frame section 400 are assembled and rigidly fixed together by first placing net 432 in the bottom cavity of frame section 300, formed by notches 362, 364, 374 and 376, so that the top edge 434 of net 432 comes into contact with surfaces 370, 372, 378, and 380. Then, frame section 400 is placed in the bottom cavity of frame section 300 so that the upper surfaces of frame piece 400 contact edge 434 of net 432 and the outer planar vertical surfaces of frame piece 400 contact vertical surfaces 366, and 368, and 382 and 384. This process traps edge 434 of net 432 between frame sections 300 and 400. Frame section 400 may be held in place in the cavity of frame piece 300 by pressure fit, adhesive, welding, clips, or by any other appropriate bonding means known to those who possess skill in the art. If ultrasonic welding is used, energy directors, such as 430, on the mating surfaces are needed.

An alternative mold structure is required for producing the second preferred embodiment. A preferred mold is formed of three pieces: a first mold piece with two cavities that form the lower portion of frame piece 300 and form insert piece 400, a second portion that forms the upper portion of frame piece 300, and a third insert piece which forms the interior of second hook 308. Preferably, the lower mold section contains molding compartments for both insert frame section 400, and for forming the lower portion of frame section 300, rather than using two separate molds. The upper section of the mold has a compartment with interior surfaces that, when filled with the appropriate plastic or molding material, will duplicate the exterior surfaces of the upper portion of the tool; preferably, the upper section of the mold will not need to have a molding compartment for section 400. This is because the upper surface of section 400 is preferably planar, and therefore, the upper mold piece should have a planar section aligned directly over the molding cavity for section 400 in the lower mold piece.

The injection material is preferably introduced into one side of the mold cavity that forms frame section 300 via a standard injection gate; a gate is defined by aligned indentations in the first and second mold pieces, and has a vertical center that is located in the horizontal plane that vertically bisects the mold cavity, just aft of neck 400. In addition, a runner, which is defined by aligned cavities in the first and second mold pieces, extends from one side of the mold cavity that forms main frame section 300 to one side of the mold cavity that forms insert frame section 400. The first and second mold pieces also have cavities that are aligned in the assembled mold to form standard exhaust vents.

The process comprises the following steps:

1. The third mold piece is secured to the second mold piece such that it forms the molding cavity for the upper portion and second hook 350.
2. The assembly made up of the second and third molding piece is joined with the first mold piece with the cavity forming the upper portion aligned above the cavity that forms the lower portion to form the complete molding cavities for frame sections 300 and 400.
3. The molding material is then introduced into the molding cavities by any standard injection molding process.
4. After sufficient cooling, the assembly made up of the second and third molding piece is separated from the first mold piece.
5. The third mold piece is separated from the second mold piece sufficiently to allow enough clearance between the third molding piece and second hook 308 of frame section 300 to facilitate its removal.
6. Frame sections 300 and 400 are removed from the mold.
7. The gate and runner are trimmed away from the sections.
8. The sections are then finished in the conventional fashion.
9. The top edge of a net is placed in the bottom cavity of frame section 300.
10. Frame section 400 is mated to the cavity in the bottom of frame section 300 where it is bonded using ultra-sound welding, or any other suitable bonding method.

The preceding descriptions are but two variations of molding embodiments; it is envisioned that injection gates may be placed at various locations and orientations in the mold, and that multiple tools may be formed in a single assembled mold.

THE THIRD AND PREFERRED EMBODIMENT

Figure 16:
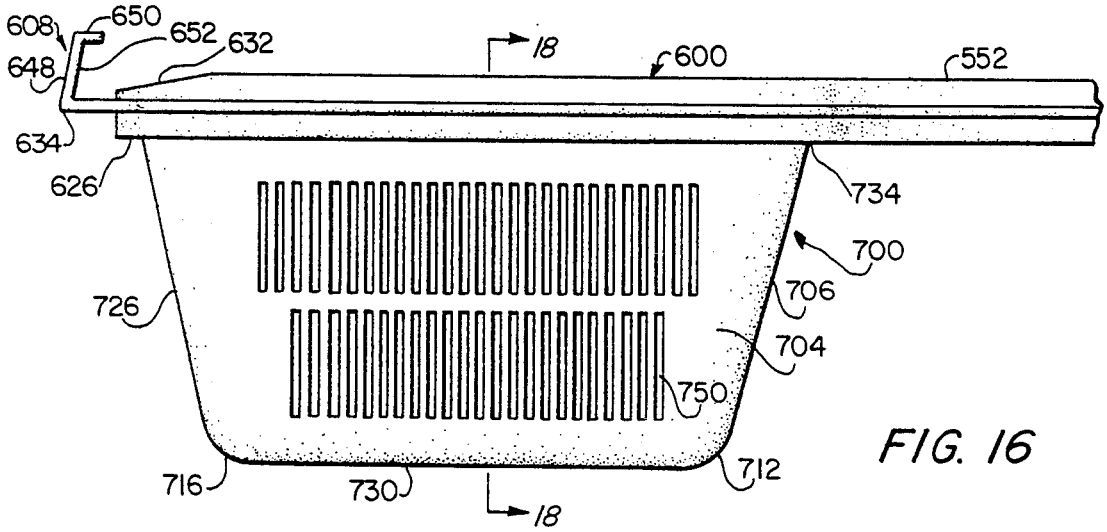
FIG. 16 is a front elevation view of a third and preferred embodiment of the invention.
Figure 17:
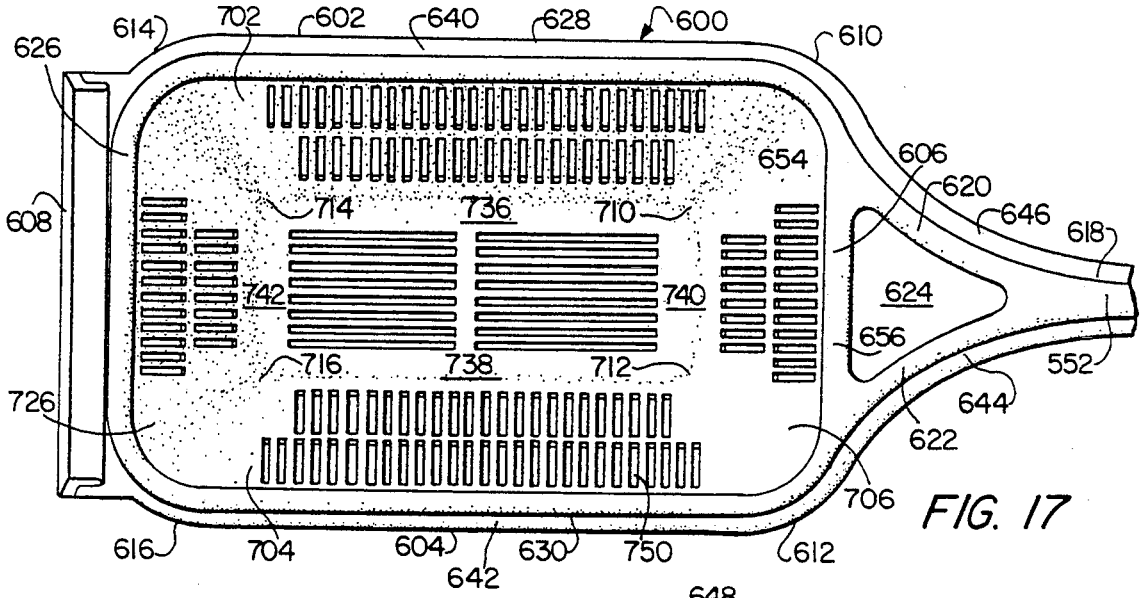
FIG. 17 is a top plan view of the third embodiment of the invention.
Figure 18:
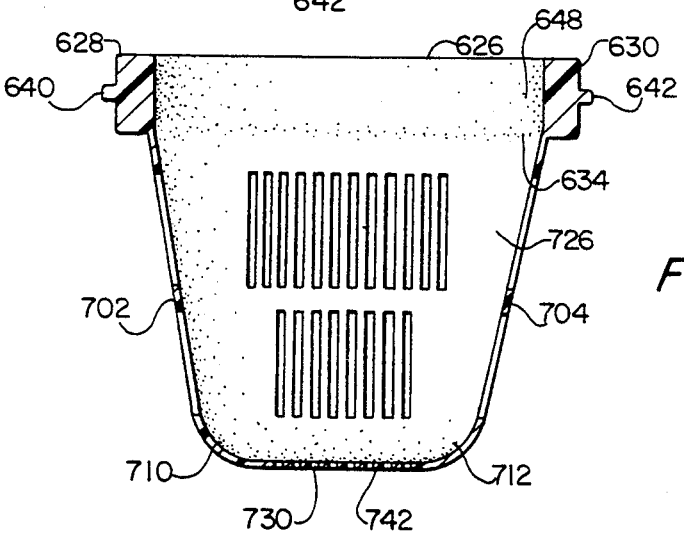
FIG. 18 is a left side elevation view of the third embodiment of the invention.

With reference to FIGS. 16, 17, and 18, a strainer basket portion of a third preferred embodiment is illustrated. Strainer basket 700 is made of a rigid or semi-rigid material, such as polypropylene. The preferred material used is a polypropylene homopolymer. Other polymers and materials may be used to form the tool 2, and the material used may contain additives to alter the strength of the tool.

Strainer basket 700, formed from sides 702, 704, 706, and 726, and bottom 730, is preferably rectangular in shape. Sides 702 and 704 are elongated, linear, perpendicular to sides 706 and 726, and equidistantly spaced from axis 3. Preferably, sides 702, 704, 706, and 726 are tapered so that their width along the upper edge 734 of the strainer basket 700 is greater than their width along the bottom 730. Corners 710, 712, 714, and 716 are radial to connect sides 702, 704, 706, and 726 to the bottom 730 in a smooth and continuous fashion.

In a preferred embodiment, sides 702, 704, 706, and 726 of strainer basket 700 extend downwardly inwardly at an angle so that they gradually converge until they merge at radial corners 710, 712, 714, and 716 to each other and to bottom 730 in a smooth, continuous fashion. Sides 736 and 738 of bottom 730 are elongated, linear, and perpendicular to sides 740 and 742 of bottom 730. Preferably, the lengths of sides 736 and 738 are equal to the lengths of sides 702 and 704 along the bottom of strainer basket 700, and the lengths of sides 740 and 742 of bottom 730 are equal to the lengths of sides 706 and 726 along the bottom of strainer basket 700.

Strainer basket 700 contains perforations 750. In a preferred embodiment, sides 702, 704, 706, and 726 and bottom 730 each contain two horizontal rows of elongated vertical rectangular perforations 750, but corners 710, 712, 714, and 716 do not contain any perforations in order to provide strength to the tool. Perforations 750 may be formed in a variety of other shapes, such as circles, and may be arranged in a variety of ways, for example in a random pattern.

Upper edge 734 of strainer basket 700 is connected to frame 10 of the first preferred embodiment, or, alternatively, to insert section 400 of frame 250 of the second preferred embodiment. Preferably, upper edge 734 of strainer basket 700 has a shape identical to that of frame 10 of the first preferred embodiment, or, alternatively, to insert section 400 of the second preferred embodiment. Strainer basket 700 may have a variety of shapes other than rectangular, for example circular or geometrical.

Frame 600 is attached to handle 552 by a neck 618. Handle 552 is the same as handle 40 of the first embodiment. Neck 618 is formed from sides 620 and 622. Ribs 644 and 646 extend horizontally an equal distance outward from the vertical centers of sides 620 and 622, respectively. In a preferred embodiment, sides 620 and 622 diverge at neck 618 and merge with radial corners 610 and 612, respectively, to form gap 624. Gap 624 enables the use of less material without significantly affecting the strength of the tool, and it provides an additional place to grip or hang tool 2.

Horizontal cross member 606, formed by beam 645 having a top surface 656, merges with corners 610 and 612 at its opposite ends in a smooth fashion. Horizontal cross member 606 is parallel to second hook 608 and perpendicular to sides 602 and 604 of frame 600. Beams 628 and 630 are parallel and form sides 602 and 604, respectively. Ribs 640 and 642 extend horizontally an equal distance outward from the horizontal center of beams 628 and 630, respectively, and merge with ribs 644 and 646 at corners 610 and 612, respectively.

Second hook 608 is formed by beam 626, which smoothly merges with beams 628 and 630 of sides 602 and 604 through radial corners 614 and 616, respectively. Projection 634 extends horizontally outward from the anterior end of beam 626 and is preferably rectangular in shape. Flange 648 extends vertically upward from beam 626 and terminates in lip 650, thereby defining space 652. Space 652 is preferably large enough to accomodate conventional skimmer basket handles.

The preferred embodiment may be produced according to the mold structure of either the first preferred embodiment or the second preferred embodiment. The first preferred embodiment employs a three-piece mold in which the first mold piece forms the portion of tool 2 that lies above the first horizontal plane. The third mold piece has an exterior shape corresponding to the shape of space 652 and releasably attaches the second mold piece to the first. The second mold piece forms the portion of tool 2 that lies below the first horizontal plane, including the skimmer basket 700.

In the second preferred embodiment, the preferred, three-piece mold includes a first mold piece which forms the lower portion of frame 600 and the strainer basket portion 700, a second mold piece that forms the upper portion of frame 600, and a third insert piece which forms the interior of second hook 608.

Injection material is preferably injected via a standard injection gate into one side of the mold cavity that forms frame 600. Under the second preferred embodiment, a runner defined by aligned cavities in the first and second mold pieces extends from one side of the mold cavity that forms the main frame section to one side of the mold cavity that forms the insert frame section.

The molding process comprises the following steps:

1. The third mold piece is secured to the second mold piece to form the molding cavity for the second hook 608.
2. The resulting assembly is then connected to the first mold piece to form the complete molding cavity, including the mold corresponding to the strainer basket 700.
3. Heated polymeric material is injected into the mold by a standard injection molding process.
4. After the material cools to a solid form, the mold assembly of pieces 2 and 3 is separated from the first mold piece.
5. The third mold piece is then separated from the second mold piece and the tool is removed.
6. The gate runner is trimmed away from the tool.
7. The tool is then finished in a conventional manner.
8. Under the second preferred embodiment, AFTER THE TOOL IS FINISHED, the main frame section is connected to the insert frame section by ultrasound welding, or any other suitable bonding method.

The tool may also be molded in other various ways, such as by single molds.

OPERATION

Figure 14:
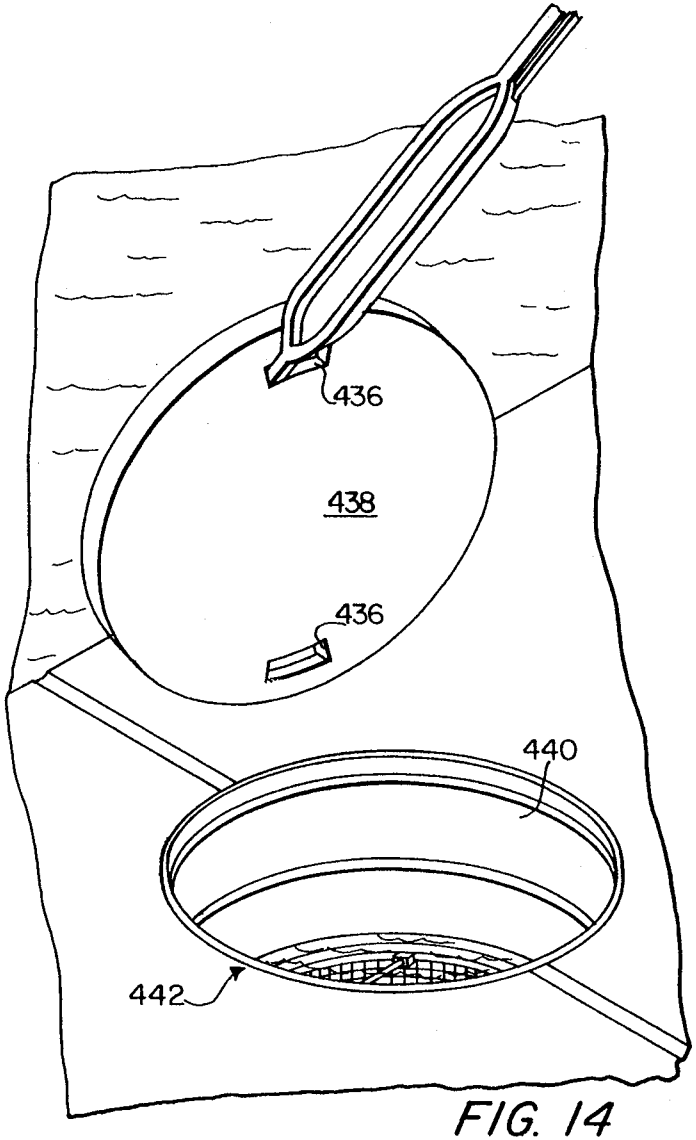
FIG. 14 is a partial view of the grip and handle portion of the preferred embodiment of the present invention lifting a pool skimmer well lid from a pool skimmer well.

With reference to FIG. 14, a preferred process for removing skimmer well lids with all embodiments of the multi-purpose skimmer tool of the present invention is illustrated. A portion of the handle, and the grip is shown with the skimmer well lid hook (not visible) inserted into orifice 436 on cover 438. The circular opening 440 of skimmer well 442 is exposed by removing cover 438. Note that orifices 436 in cover 438 have shapes that match the curvature of the round edge of cover 438; of course, any other well cover shape may be used, provided at least one opening is present to allow for insertion of the lid hook. It is necessary to align the hook lengthwise with one of orifices 436, insert the hook downward through the orifice, and rotate the skimmer tool so that, upon lifting of the tool, the inner surface of the hook engages the lower surface (not shown) of cover 438, enabling the user to remove cover 438 from well 442 by applying upward pressure.

Figure 15:
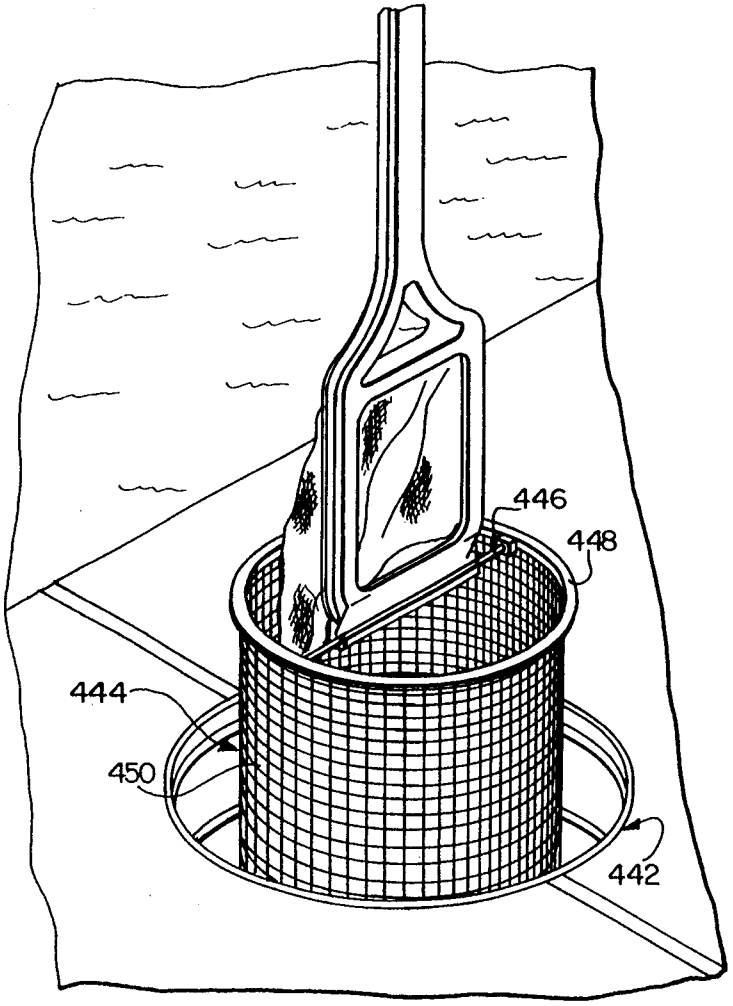
FIG. 15 is a partial view of the net and net frame portion of the preferred embodiment of the present invention lifting a skimmer basket from a pool skimmer well.

With reference to FIG. 15, the first embodiment of the present invention is illustrated removing a skimmer pail 444 from a skimmer well 442. However, the other embodiments are usable in exactly the same manner for the same purpose. Pail 444 has a handle 446 which extends across its circular lip 448 at the top of cylindrical side 450. Note that handle 446 fits into the space formed by the elongated hook on the net frame. By lifting the tool with handle 446 inserted in the elongated hook, a user can easily lift pail 444 without exposing the hands or face to pool scum, leaves, and the assortment of dead/alive insects, snakes, and other animals that may be trapped in the skimmer baskets. In situations where a skimmer basket is not clogged, but leaves and other debris are floating in the water flowing through the basket, the net can be used to remove the floating matter, without removing the skimmer basket, and without having to stoop or kneel down or use the hands to remove the debris.

The pail carrying feature of the multi-purpose tool of the present invention may also be useful for painters to raise and lower buckets of paint and/or other chemicals and solutions when working on a ladder. For example, a bucket or pail may be held by the hook on the net frame, and the tool and bucket can be hung from a hook inserted through a hole in the grip.

Thus, it is obvious that, although three embodiments have been described and illustrated herein, various alterations, modifications and substitutions may be apparent to one of skill in the art without departing from the essential spirit of the invention. The scope of the invention is accordingly defined by the following claims.

We claim:

1. A multipurpose tool, comprising:

a strainer having a first end and a second end;

a handle having an attached end and a hook end, wherein said attached end is attached to said first end of said strainer;

a first hook attached to said hook end of said handle; and a second hook attached to said second end of said strainer;

grip means on said handle for grasping and manipulating said multipurpose tool; and at least one hanging means for hanging storage or use of said device, wherein:

said strainer comprises a frame and a strainer basket attached to said frame, said frame having a hook piece and a handle piece; wherein:

said handle piece is connected to said attached end of said handle;

said first hook projects from said hook end of said handle;

said second hook projects from said hook piece;

said handle comprises a first beam having an anterior end and a posterior end, said first beam being elongated and linear, said first beam having a vertical center and two opposed vertical outer surfaces, said first beam having two horizontal linear ribs projecting outwardly from said vertical center of said opposed vertical surfaces;

said grip means comprises a second beam and a third beam, said second beam and said third beam each having an anterior end and a posterior end; wherein:

said anterior end of said second beam and said anterior end of said third beam are connected to said posterior end of said first beam and project in opposed directions therefrom, said second beam and said third beam are bent at least twice to each have a diverging portion, a parallel portion, and a converging portion, wherein said diverging portions are located at said front ends of said second beam and said third beam, said converging portions are located at said posterior ends of said second beam and said third beam, and said parallel portions are located between said converging portions and said diverging portions, said parallel portions being substantially linear and elongated, wherein said parallel portion of said second beam has a first section that is spaced from and parallel to a second section of said parallel postion of said third beam, and wherein said posterior ends of said second beam and said third beam are connected to form a junction;

said second beam and said third beam each further comrpising a vertical center and opposed inner and outer surfaces, wherein:

said inner surface of said second beam faces said inner surface of said third beam;

said vertical centers of said first beam, said second beam, and said third beam lie in a first plane, said second beam and said third beam being equidistantly spaced from the longitudinal axis of said first beam, and said axis lies in said first plane passing through said vertical centers of said beams; and said strainer basket comprises opposed inner and outer sides, first and second opposed sides joining said inner and outer sides, a bottom, four radial corners joining said sides to said bottom, and perforations in said sides and said bottom.

2. The multipurpose tool of claim 1, wherein said tool is molded from a polymer.

3. The multipurpose tool according to claim 1, wherein said frame, said strainer basket, said handle means, said grip means, and said hook means are molded from polypropylene, and wherein said tool will float in water.

4. The multipurpose tool according to claim 1, further comprising an insert piece, wherein:

said handle, grip, and frame are formed as a single piece having an outer periphery, and said handle and said frame having a continuous rib extending outwardly along said outer periphery;

said insert piece and staid strainer basket are formed as a single piece; and said said insert piece is attached to said frame.

5. A multipurpose pool skimmer tool comprising:

a handle having a first end and a second end;

a frame extending from said first end of said handle, said frame having oppposed, generally linear, inner and outer ends, and first and second opposed sides joining said inner and outer ends, and said frame being joined to said first end of said handle along said inner end;

a grip extending from said second end of said handle, said grip having opposed inner and outer ends and being joined to said second end of said handle at said inner end; and a strainer basket attached to said rectangular frame;

said handle having a basket handle hook formed along substantially the entire length of said outer end thereof, said grip having a well lid hook extending outwardly from said outer end thereof; and said strainer basket having opposed inner and outer sides, first and second opposed sides joining said inner and outer sides, a bottom, four radial corners joining said sides to said bottom, and perforations in said sides and said bottom.

6. The tool of claim 5 wherein said handle, grip, strainer basket, and frame are formed as a single piece having an outer periphery, and said handle and said frame having a continuous rib extending outwardly along said outer periphery, said hook being formed as a continuation of said rib.

7. The tool of claim 5, wherein said frame has a substantially rectangular transverse cross-section.

8. The tool of claim 7, wherein said strainer basket has a substantially rectangular transverse cross-section for matingly engaging said frame.

9. The tool of claim 5, further comprising an insert piece, wherein:

said handle, grip, and frame are formed as a single piece having an outer periphery, and said handle and said frame having a continuous rib extending outwardly along said outer periphery;

said insert piece and staid strainer basket are formed as a single piece; and said said insert piece is attached to said frame.

10. The tool of claim 9, wherein said insert means has a substantially rectangular transverse cross-section for matingly engaging said frame for attaching said strainer basket to said frame.

11. The tool of claim 10, wherein said strainer basket has a substantially rectangular transverse cross-section for matingly engaging said insert piece for attaching said strainer basket to said frame.

12. A multipurpose pool skimmer tool comprising:

a handle having a first end and a second end;

a frame extending from said first end of said handle, said frame having a generally linear outer end and an inner end generally opposite said outer end, and said frame being joined to said first end of said handle along said inner end;

a grip extending from said second end of said handle, said grip having opposed inner and outer ends and being joined to said second end of said handle at said inner end; and a strainer basket attached to said rectangular frame;

said handle having a basket handle hook formed along substantially the entire length of said outer end thereof;

said grip having a well lid hook extending outwardly from said outer end thereof; and said strainer basket having opposed inner and outer sides, first and second opposed sides joining said inner and outer sides, a bottom, four radial corners joining said sides to said bottom, and perforations in said sides and said bottom.

13. The tool of claim 12, wherein said handle, grip, strainer basket and frame are formed as a single piece having an outer periphery, and said handle and said frame having a continuous rib extending outwardly along said outer periphery, said hook being formed as a continuation of said rib.

14. The tool of claim 12, wherein said frame has a substantially rectangular transverse cross-section.

15. The tool of claim 14, wherein said strainer basket has a substantially rectangular transverse cross-section for matingly engaging said frame.

16. The tool of claim 12 further comprising an insert piece, wherein:

said handle, grip, and frame are formed as a single piece having an outer periphery, and said handle and said frame having a continuous rib extending outwardly along said outer periphery;

said insert piece and said strainer basket are formed as a single piece; and said insert piece is attached to said frame.

17. The tool of claim 16, wherein said insert means has a substantially rectangular transverse cross-section for matingly engaging said frame for attaching said strainer basket to said frame.

18. The tool of claim 17, wherein said strainer basket has a substantially rectangular transverse cross-section for matingly engaging said insert piece for attaching said strainer basket to said frame.

19. A multipurpose pool skimmer tool comprising:

a handle having a first end and a second end;

a rectangular frame extending from said first end of said handle, said frame having a generally linear outer end and an inner end generally opposite said outer end, and said frame being joined to said first end of said handle along said inner end;

a grip extending from said second end of said handle, said grip having opposed inner and outer ends and being joined to said second end of said handle at said inner end; and a strainer basket attached to said rectangular frame;

said handle having a basket handle hook formed along substantially the entire length of said outer end thereof;

said grip having a well lid hook extending outwardly from said outer end thereof; and said strainer basket having opposed inner and outer sides, first and second opposed sides joining said inner and outer sides, a bottom, four radial corners joining said sides to said bottom, and perforations in said sides and said bottom.

20. The tool of claim 19, wherein said handle, grip, strainer basket and frame are formed as a single piece having an outer periphery, and said handle and said frame having a continuous rib extending outwardly along said outer periphery, said hook being formed as a continuation of said rib.

21. The tool of claim 19, wherein said frame has a substantially rectangular transverse cross-section.

22. The tool of claim 21, wherein said strainer basket has a substantially rectangular transverse cross-section for matingly engaging said frame.

23. The tool of claim 19 further comprising an insert piece, wherein:

said handle, grip, and frame are formed as a single piece having an outer periphery, and said handle and said frame having a continuous rib extending outwardly along said outer periphery;

said insert piece and said strainer basket are formed as a single piece; and said insert piece is attached to said frame.

24. The tool of claim 23, wherein said insert means has a substantially rectangular transverse cross-section for matingly engaging said frame for attaching said strainer basket to said frame.

25. The tool of claim 24, wherein said strainer basket has a substantially rectangular transverse cross-section for matingly engaging said insert piece for attaching said strainer basket to said frame.

* * * * *